United States Patent [19]

Myers et al.

[11] 3,985,098

[45] Oct. 12, 1976

[54] TONER DISPENSING APPARATUS

[75] Inventors: Charles E. Myers, Woburn; James E. Genthe, Chelmsford, both of Mass.

[73] Assignee: Itek Corporation, Lexington, Mass.

[22] Filed: Jan. 20, 1975

[21] Appl. No.: 542,319

[52] U.S. Cl. ..... 118/637; 222/241; 222/414

[51] Int. Cl.[2] ..... G03G 15/08

[58] Field of Search ..... 118/637; 222/DIG. 1, 222/236, 239, 241, 410, 414

[56] References Cited

UNITED STATES PATENTS

| | | | |
|---|---|---|---|
| 3,103,445 | 9/1963 | Bogdonoff et al. | 427/21 |
| 3,149,760 | 9/1964 | Eichorn et al. | 222/238 |
| 3,176,881 | 4/1965 | Malby et al. | 222/414 |
| 3,305,141 | 2/1967 | Wheeler | 222/414 |
| 3,310,205 | 3/1967 | Meyer | 222/414 |
| 3,572,555 | 3/1971 | Knight et al. | 222/342 |
| 3,622,054 | 11/1971 | Davidson | 222/404 |
| 3,659,556 | 5/1972 | Mutschler | 118/637 |
| 3,697,050 | 10/1972 | Stanley | 118/637 |
| 3,724,422 | 4/1973 | Latone et al. | 118/637 |
| 3,825,936 | 7/1974 | Ott et al. | 118/637 |

OTHER PUBLICATIONS

IBM Technical Disclosure Bulletin; Daniels, R. A.; vol. 17, No. 4, Sept. 1974, pp. 1094–1095.

*Primary Examiner*—Mervin Stein
*Assistant Examiner*—Douglas Salser
*Attorney, Agent, or Firm*—Homer O. Blair; Robert L. Nathans; Gerald H. Glanzman

[57] ABSTRACT

A toner dispensing apparatus for electrophotographic copiers. The dispenser includes an elongated hollow tubular member extending across the developer assembly of the copier within which is positioned a rotatable auger of novel construction having a helical groove formed around its surface. One end of the auger extends out of the tubular member into a toner supply container which is adapted to feed fresh toner into the groove of the auger. Rotation of the auger transports closely metered amounts of toner from the supply container into and along the tubular member and as it is carried there along, the toner will be automatically dispensed in precise amounts through a plurality of apertures extending along the bottom of the tubular member. According to one important feature of the invention, the toner dispenser is supported across the developer assembly in a position to dispense toner into the developer as it is falling from the development zone toward the elevator sump. This provides an opportunity for effective mixing of the toner with the developer without the need for rotating mixing screws or the like in the elevator sump, although a stationary crossmixer is preferably provided to assist in the mixing activity.

20 Claims, 5 Drawing Figures

FIG. 2A.
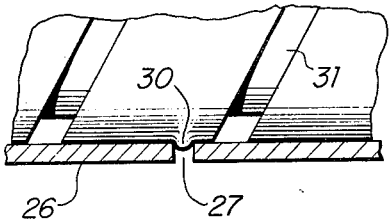
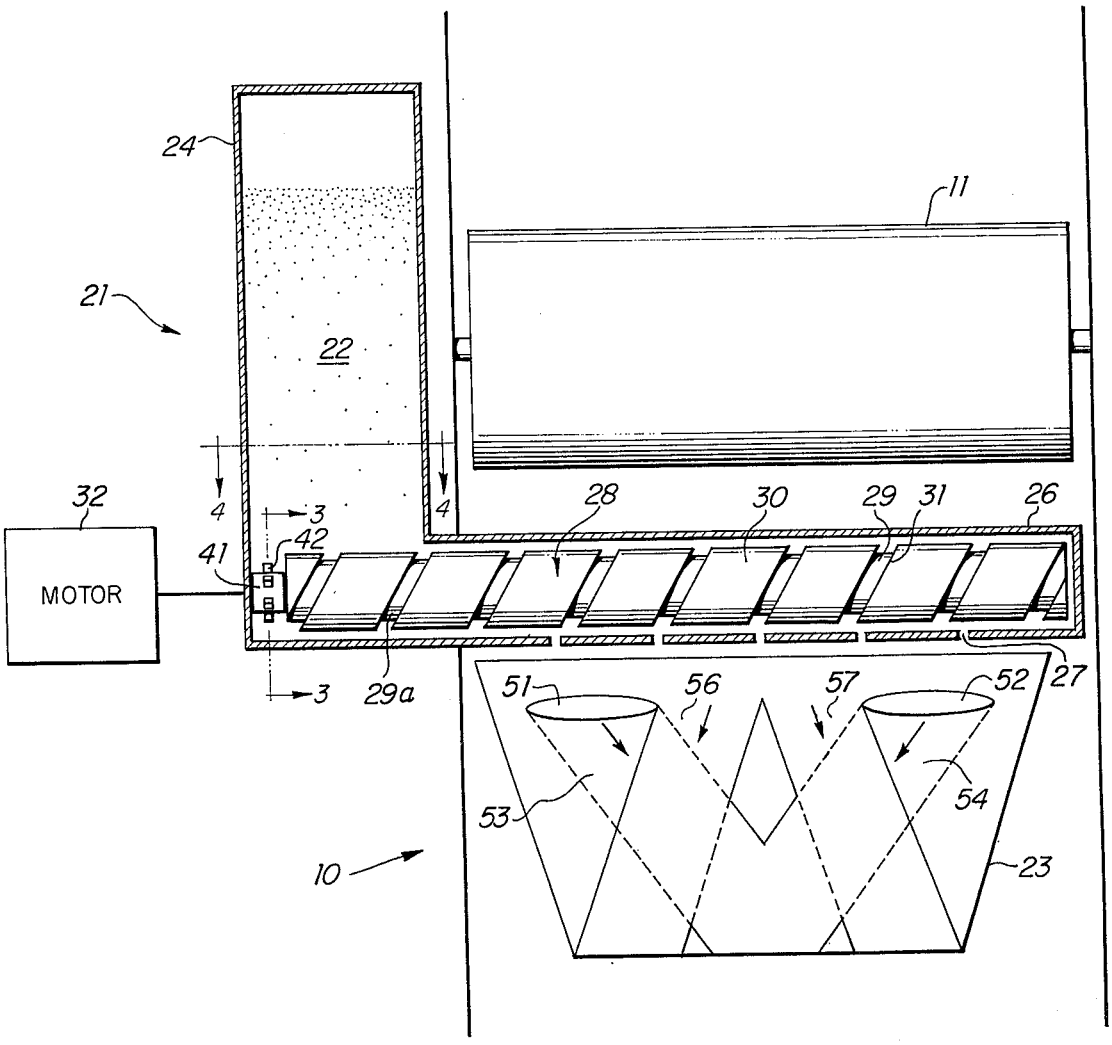
FIG. 2.

TONER DISPENSING APPARATUS

BACKGROUND OF THE INVENTION

1. Field of the Invention

The present invention relates generally to the field of electrophotographic copiers, and, more particularly, to an improved toner dispenser for use in the developer assembly of an electrophotographic copier.

2. Description of the Prior Art

In electrophotographic copiers utilizing typical cascade development techniques, a latent electrostatic image is formed on a photoconductive insulating member and then developed by cascading a developer mixture over the image as it is carried through a development zone. This developer mixture typically consists of relatively large particles or carrier beads and many smaller pigmented toner particles which electrostatically cling to the carrier, and as this developer mixture cascades through the development zone and over the latent electrostatic image, toner particles are separated from the carrier and deposited on the image to develop it. After completing its passage through the development zone, the developer mixture is then generally accumulated in a sump in the bottom of the development unit to be eventually picked up by a suitable conveyor and returned to the top of the unit to be dropped back through the development zone to develop later images.

Because, during each development, toner is pulled off of the carrier beads and deposited on the electrostatic image, it is necessary that this toner be replaced to ensure that the developer mixture will always have an adequate concentration of toner. Accordingly, most copying machines additionally include some form of toner dispenser to supply fresh toner to the developer prior to its being returned to the top of the development zone.

Although a large variety of toner dispensers have been developed and are being used in the prior art, most of them are not fully satisfactory for a variety of reasons. For one thing, many of the prior art toner dispensers are sensitive to external factors such as the amount of toner in the supply hopper, machine vibrations and the like. Accordingly, the rate at which toner is dispensed is frequently not controllable to the extent and to the accuracy desired. Also, many of the existing systems are relatively complicated and require frequent repair. Furthermore, because of their physical locations, which are dictated by developer assembly space and toner storage capacity limitations, most of the toner dispensers presently being used are not designed to assist in mixing the fresh toner with the developer. In this regard, it is desirable that the developer and the fresh toner be well mixed prior to its being re-cascaded through the development zone because it is this mixing activity which triboelectrically charges the toner so that it can be properly deposited on the latent electrostatic image. With many of the systems available today, it has been found necessary to use rotating screws or some other type of mechanical mixer to ensure proper mixing of the fresh toner with the developer and this mechanical mixing is not desirable because it adds complexity and cost and can excessively abrade the developer.

In general, there is a need for an improved toner dispensing apparatus which can reliably dispense metered amounts of fresh toner to the developer and which is designed in such a manner that ample mixing of the fresh toner with the developer can be accomplished in a simple and efficient manner.

SUMMARY OF THE PREFERRED EMBODIMENT

In accordance with the present invention, a toner dispenser which overcomes many of the above-described prior art inadequacies has been provided. According to a presently most preferred embodiment, this toner dispenser includes an elongated hollow tubular member extending across the developer assembly and having a plurality of spaced apertures positioned along the bottom thereof. Positioned within the tubular member is an auger of novel construction having a helical groove or grooves formed around its surface. One end of this auger extends out of the tubular member and is adapted to cooperate with a toner supply reservoir positioned exteriorly of the developer housing from which it may pick up toner to be dispensed. Specifically, as the auger rotates, it will pick up a closely metered amount of fresh toner from the toner supply reservoir and carry it within the helical groove or channel into and along the tubular member. As the toner is channeled along the tubular member, it will be carried across the apertures therein and some toner will be dispensed out of each of them. The auger itself preferably comprises a rod covered by a layer of open celled foam material within which the helical groove is cut. This type of construction permits the toner to be effectively carried in the groove and to be positively dispensed through the apertures in the tubular member in a fairly precise manner such that controlled amounts of toner will fall through each of the apertures in the tubular member.

According to a second feature of the invention, the toner dispenser is positioned relatively close to the bottom of the development zone between the bottom of the zone and the conveyor sump such that the toner will be dispensed into the developer immediately after it leaves the development zone and while it is still falling into the sump. Accordingly, substantial mixing of the toner and developer will automatically take place by the time that it reaches the sump. Preferably, also, a relatively simple cross-mixing structure is provided to further assist in the mixing activity.

In general, the present invention provides a reliable toner dispensing system which permits accurate control over the amount of toner being dispensed and which makes possible effective mixing of the toner with the developer without the need for any moving mixers or the like. Additional features and advantages of the invention will be set forth in detail hereinafter.

BRIEF DESCRIPTION OF THE DRAWINGS

FIG. 2 illustrates the toner dispenser and crossmixer according to the present invention looking generally in the direction of arrow 2 in FIG. 1, with portions being shown in cross-section for clarity.

FIG. 2A illustrates a portion of the toner dispenser of FIG. 2 to assist in explaining the invention.

DETAILED DESCRIPTION OF THE PREFERRED EMBODIMENT

Figure 1:
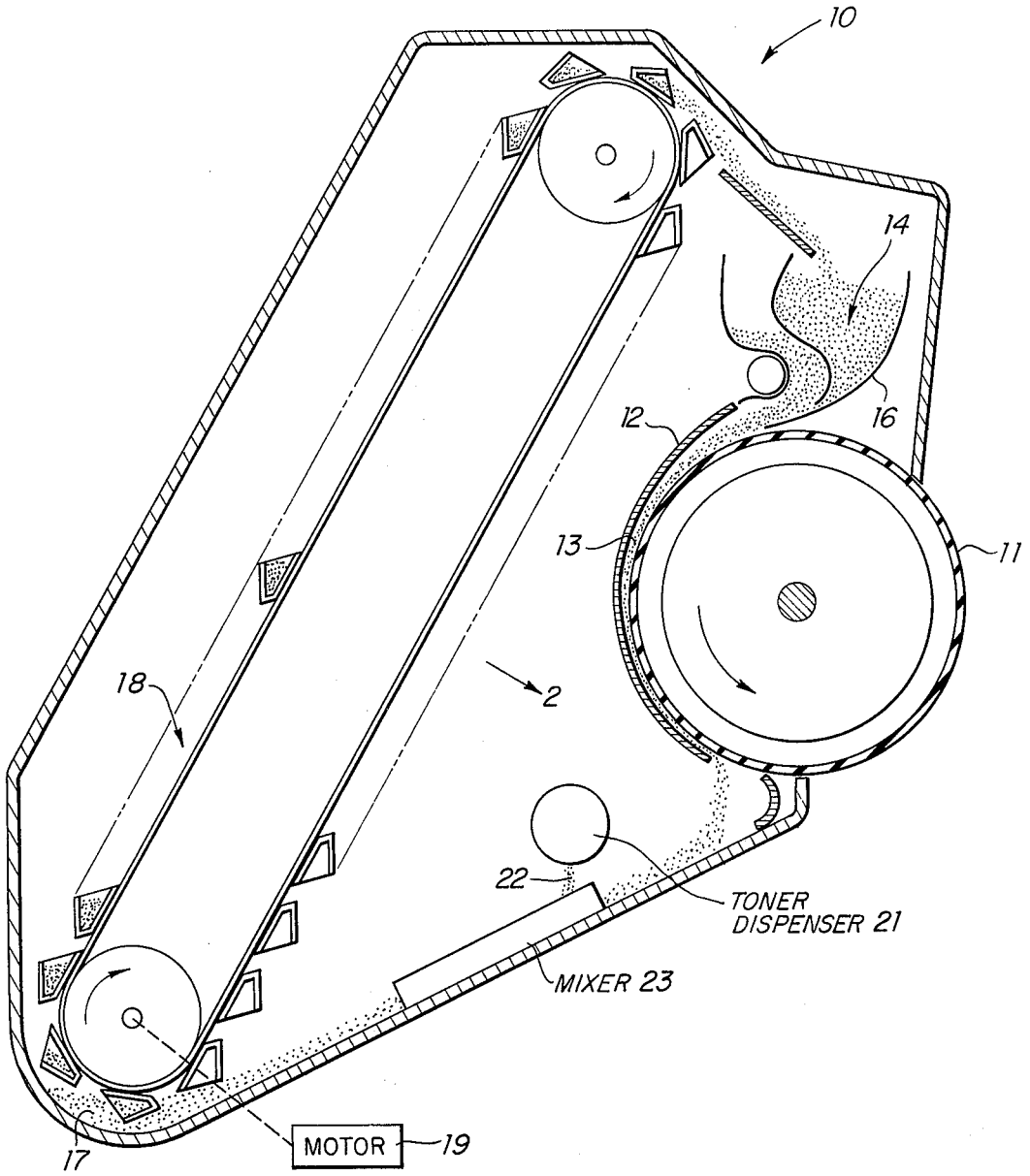
FIG. 1 schematically illustrates the developer assembly of an electrophotographic copier according to the present invention.

FIG. 1 schematically illustrates the developer assembly of an electrophotographic copier. Other conventional portions of the machine such as the corona charging station, the exposure station, and the drum cleaning station as well as many of the details of the developer assembly itself have not been illustrated in the interest of clarity and because they are not relevant to an understanding of the present invention.

The developer assembly itself is generally identified by reference number 10 and is adapted to cooperate with what may be a conventional xerographic drum 11 upon the surface of which a latent electrostatic image to be developed can be applied in a conventional manner. More specifically, the developer assembly 10 includes a development plate or electrode 12 which is spaced from the surface of drum 11 to define a development zone 13 within which development takes place. Development is accomplished by cascading a developer mixture 14 in the form of carrier and toner through the development zone 13 from a developer applicator 16 as is well understood. As the developer 14 cascades downwardly through the development zone, toner will be attracted to and deposited on the latent electrostatic image on the drum to develop it. After passing through the development zone, the developer thereafter falls to the bottom of the developer assembly and accumulates in a conveyor sump portion 17 where it is adapted to be picked up by a suitable conveyor 18 driven by motor 19 and transported back to the top of the development housing to be re-cascaded through the development zone during later development operations.

As is well known, the obtaining of consistently high quality, fully developed images over an extended period of time requires that the developer mixture be maintained at the proper toner concentration at all times; and, since toner is removed from the developer mixture during development, it becomes necessary to add fresh toner to the system. It is towards this area that the present invention is primarily directed, and in FIG. 1, a toner dispenser 21 is schematically illustrated. Toner dispenser 21 is positioned close to the output end of development zone 13, for reasons to be described in detail hereinafter, and dispenses toner 22 into a mixer 23 which assists in mixing the fresh toner with the developer also passing through the mixer as will also be explained more completely hereinafter. Toner dispenser 21, mixer 23 and their relationship in the developer assembly with drum 11 are illustrated more clearly in FIG. 2, which is a view of portions of the system looking generally in the direction of arrow 2 of FIG. 1 and in which some portions are shown in cross-section for clarity.

As illustrated in FIG. 2, toner dispenser 21 initially includes a toner supply housing or hopper 24 which is adapted to hold a large supply of fresh toner to be gradually dispensed into the developer assembly. Housing 24, itself is supported outside of the developer assembly 10 (for ease in refilling or replacement and to permit a larger supply of toner to be maintained), but is coupled adjacent its bottom to a hollow tubular member or housing 26 which extends into and substantially completely across the developer assembly. Positioned in the bottom of tubular housing 26 are a plurality of spaced apertures 27, preferably five in number, which extend in a line across the developer assembly, and it is through these apertures that toner is dispensed to be mixed with and added to the developer passing thereunder.

In order to transport the fresh toner from supply hopper 24 into the developer assembly, an auger of novel construction is provided. This auger, generally identified by reference number 28, consists of a core 29 which may be of metal or other material surrounded by a covering of open celled foam material 30 such as urethane foam. Furthermore, the foam is cut through or otherwise manufactured so as to form a helical channel or groove 31 around the surface of the auger. Auger 28 is preferably sized to fit within tubular housing 26 with a very slight interference such that the foam will be slightly compressed within housing 26. In FIG. 2, a clearance has been shown between the auger and housing 26, but this was done for clarity only. The auger 28 is adapted to be driven into rotation by means of a motor schematically illustrated by reference number 32.

Figure 3:
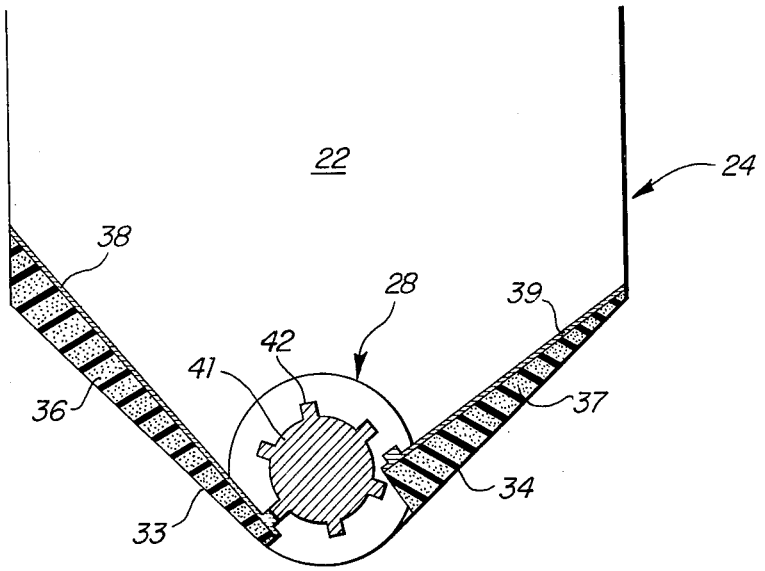
FIG. 3 illustrates a cross-sectional view of the toner dispenser looking in the direction of arrow 3—3 in FIG. 2.
Figure 4:
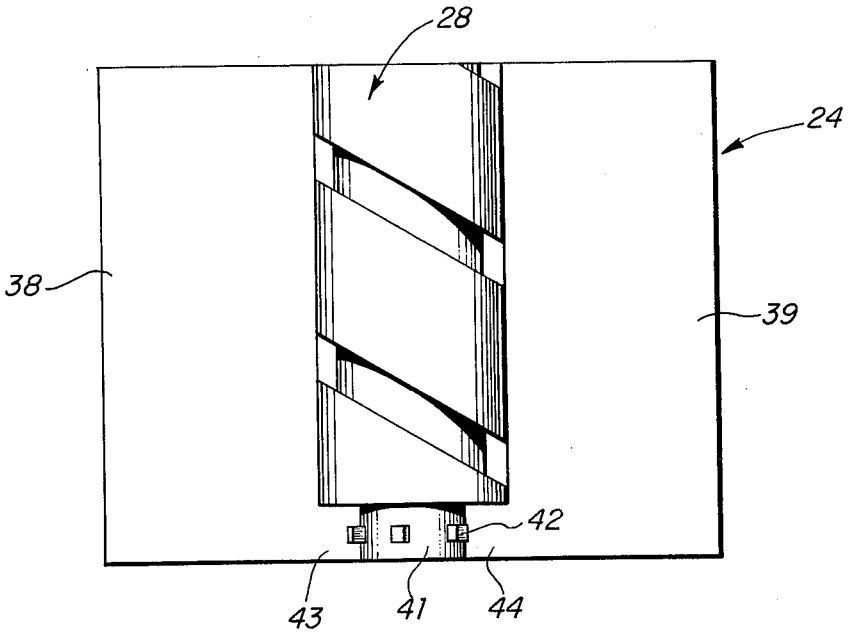
FIG. 4 illustrates a cross-sectional view of the toner dispenser looking in the direction of arrow 4—4 in FIG. 2.

As mentioned above, auger 28 is provided to receive toner from supply hopper 24 and to transport it into the developer assembly to be dispensed. The manner in which this is accomplished is illustrated most clearly in FIGS. 3 and 4. In FIG. 3, it can be seen that the bottom portion of supply housing 24 is defined by lower walls 33 and 34 coming together to form a somewhat V-shaped trough. The auger 28 extends within this V as illustrated. Positioned on walls 33 and 34 are layers of foam rubber 36 and 37, respectively, and supported on top of the foam rubber layers are a pair of vibratable shaker plates 38 and 39, respectively. These shaker plates extend across the supply housing 24 as shown more clearly in FIG. 4 and rest on the auger while leaving the grooves in the auger uncovered to receive toner. This toner, however, is extremely fine and tends to bridge and not flow freely. Accordingly, the function of the shaker plates 38 and 39 are to oscillate and vibrate to break up this tendency to coalesce and permit the toner to flow into the helical groove of the auger.

The structure for vibrating the plates can take many forms. In the presently preferred embodiment illustrated, the auger 28 is provided with a knob 41 (FIGS. 3 and 4), rotatable with the auger and having a plurality of screws or projections 42 (e.g., six), positioned around its periphery. These projections are adapted to cooperate with tabs 43 and 44 integral with the shaker plates 38 and 39, respectively. Thus, as the auger is rotated by motor 32 the coaction of the projections 42 with the tabs 43 and 44 will cause the plates 38 and 39 to vibrate and break up any tendency for the toner to coalesce. The foam rubber layers 36 and 37 are provided to assist in vibrating the shaker plates and additionally to prevent toner from falling beneath the plates which can clog up the system and affect metering accuracy.

In order to best understand the manner in which the toner dispenser operates, a brief description of its operation will now be provided. When it is first desired to dispense fresh toner into the developer assembly, motor 32 is actuated to drive the auger 28 into rotation. As the auger rotates, the knob 41 will also rotate and its projections 42 will cause the shaker plates 38 and 39 to begin vibrating to break up the toner 22 in supply hopper 24 which, in turn, allows relatively precise amounts of toner to fall into the groove portion 29*a* of helical groove 29 that is positioned within supply housing 24. Continued rotation of the auger then causes the toner within the groove to be transported into and through the length of the tubular member 26. During this transport, a particular portion of the helical groove will cross each of the plurality of apertures 27 in sequence and when it does so, a small amount of toner will fall out through each of the apertures into the developer stream passing thereunder. Because of the extreme fineness of the toner, only a portion of the toner within the groove will fall through each aperture and by properly controlling the speed of rotation of the auger the size of the groove and the like, it becomes a fairly simple manner to ensure that a fairly precise amount of toner will fall through each of the five apertures. Because the foam layer 30 covering the auger is highly resilient and because it fits in the tube 26 with some interference, the rubber will assist in the dispensing of toner by actually channelling the toner toward and through the apertures 27, and, by doing so, in wiping the apertures clean. Without such assistance, the extreme fineness of the toner could cause it to clog up the apertures and prevent the toner from flowing smoothly through the apertures. This feature is illustrated more clearly in FIG. 2A wherein it can be seen how resilient surface 30 actually expands slightly into apertures 27.

In the specific toner dispenser designed by the invention for use in a machine having a 10 inch xerographic drum, the tubular housing 26 is also about 10 inches in length. The auger is about 14 inches long with about 4 inches extending into toner supply hopper 24. Both the auger 28 and the hollow tube 26 are about 1 5/16 inches in diameter although as mentioned above, the auger is preferably about 0.001 to 0.005 inches thicker to fit in the tube with some interference. There are preferably five apertures 27 in the tube which may be generally equally spaced and aligned in a row about 6 inches long within the center of the developer assembly. There are preferably no apertures provided on either end of the developer assembly as it is desirable to minimize the amount of toner in those areas. The apertures themselves have a nominal diameter of about 5/32 inches although this can be varied if desired to permit precise control over the metering rate through the apertures.

The groove or channel in the auger is preferably about ¼ inches and about 3/16 inches deep and preferably there are two helical grooves on the auger to provide a double helix configuration having about a 2 inch pitch. The auger is designed to rotate at a constant speed of, for example, 20 r.p.m. with a variable duty cycle for the system being a function of the toner depletion rate during development of the latent electrostatic image. It is also possible, if desired, to control the rate of toner dispensing by varing the rate of auger rotation but this is not preferred.

The shaker plates 38 and 39 should be vibrated about 1 to 10 times per auger rovolution, although this can be varied greatly. Preferably also, the two plates are vibrated out of phase from one another. It is also within the scope of the invention to cause one of the plates to vibrate at a slower rate, if desired or needed.

As mentioned previously, it is desirable for the effective operation of the development system that the fresh toner dispensed by dispenser 21 be properly mixed with the developer already in the system to ensure that the carrier is uniformly coated with toner and that the toner is given the proper tribo-electric charge. In many systems presently on the market, this is accomplished through the use of some form of movable mixer such as rotating screws or the like which can abrade and otherwise damage the developer. With the toner dispenser of the present invention, however, this can be avoided. In FIG. 2, a stationary mixer which can effectively be used is illustrated. It basically comprises a cross-mixer 23 is smoothly redirect the toner and developer passing through it. Specifically, the cross-mixer 23 is positioned in the path of the developer leaving the development zone 13 (FIG. 1) and directly below the toner dispenser 21. Developer falling along either edge of the developer assembly as well as toner dispensed from the apertures in either end of the tube 26 will fall into openings 51 and 52 of the mixer to be carried along the lower passages 53 and 54 towards the center of the development zone. At the same time, developer flowing in the central area of the development zone and toner dispensed from central apertures in tube 26 will be directed along upper paths 56 and 57 toward the edges of the development zone. The combination of this cross-mixer together with the fact that the developer will fall through a substantial distance before it reaches conveyor sump 17 (FIG. 1) ensures that a substantial amount of mixing activity will take place such that by the time the depleted developer and fresh toner passes through sump 17, is picked up by conveyor 18 and gets back to the development zone, it will be adequately mixed and no additional mixing devices need be provided.

Although the cross-mixer is not essential to the proper operation of the present invention, it is preferred because it makes it possible to reduce the number of apertures in tube 26.

One of the valuable features of the present invention is that the toner supply housing 24 is located outside of the developer assembly. Thus, when it requires refilling or replacing, it can be reached very easily. Also, because it is outside of the developer assembly, it can be made much larger than normal and need not be refilled as often. For the same reason, only the relatively small tubular member 26 need be positioned within the developer assembly itself, and this provides greater flexibility as to its location. Without having the toner supply housing outside of the assembly, and without transporting toner into the assembly from the side, as in the present invention, it would be extremely difficult to position the dispenser at the preferred location directly beneath the development zone.

In summary, the present invention provides a toner dispenser which is very effective in dispensing metered amounts of toner into the developer station of an electrophotographic copier. It permits metered amounts of toner to be accurately dispensed into the system and is not affected by external conditions of the machine. While what has been described is a presently most preferred embodiment, it should be recognized that the invention could take many other forms. For example, it is possible for the auger to be manufactured with a bristle-type resilient cover or with some other material rather than with a foam. Also, the cross-mixer could take a variety of other forms. Accordingly, it should be understood that the invention should be limited only insofar as required by the following claims.

What is claimed is:

1. Toner dispensing apparatus for electrophotographic copiers comprising:

a. an elongated housing, said housing having aperture means extending through a lower wall thereof;

b. toner supply means for holding a supply of toner to be dispensed;

c. elongated auger means, one end of said auger means cooperating with and being positioned to receive toner from said toner supply means and the other end of said auger means being positioned within said elongated housing, said auger means having a resilient surface and a helical channel formed therearound within said resilient surface; and, d. means for rotating said auger means, the rotation thereof causing toner positioned within said helical channel to be transferred from said one end of said auger means toward said other end thereof whereby toner will be dispensed through said aperture means as said helical channel moves thereacross.

2. Apparatus as recited in claim 1 wherein said aperture means comprises a plurality of apertures extending generally in a line along the length of said elongated housing.

3. Apparatus as recited in claim 1 wherein said resilient surface comprises an open-celled foam material.

4. Apparatus as recited in claim 1 wherein said auger means fits within said elongated housing with a slight amount of interference such that said resilient surface will be slightly compressed therein to assist in dispensing toner through said apertures.

5. Apparatus as recited in claim 1 wherein said toner supply means includes a container and wherein said one end of said auger means extends within said container, said container including means for depositing toner into that portion of said helical channel that is within said container.

6. Apparatus as recited in claim 5 wherein said toner depositing means comprising agitator means for agitating the toner within said container to allow it to enter into said helical channel.

7. Toner dispensing apparatus for electrophotographic copiers comprising:

a. an elongated housing, said housing having aperture means extending through a lower wall thereof;

b. toner supply means for holding a supply of toner to be dispensed;

c. elongated auger means having a helical channel formed around its surface, one end of said auger means being positioned within said toner supply means and the other end of said auger means being positioned with said elongated housing;

d. agitator means within said toner supply means for agitating said toner within said toner supply means for depositing toner into that portion of said helical channel that is positioned within said toner supply means, said agitator means comprising vibrating plate means for directing toner into said helical channel; and, e. means for rotating said auger means, the rotation thereof causing toner positioned within said helical channel to be transferred from said one end of said auger means toward said other end thereof whereby toner will be dispensed through said aperture means as said helical channel moves thereacross.

8. Apparatus as recited in claim 7 including means on said auger means for vibrating said vibrating plate means during the rotation thereof.

9. Apparatus as recited in claim 8 wherein said vibrating plate means include tab means and wherein said auger means has projection means coupled thereto and rotatable therewith, said projection means cooperating with said tab means to vibrate said vibrating plate means during the rotation of said auger means.

10. Apparatus as recited in claim 7 wherein said vibrating plate means are supported on a resilient backing.

11. In a developer assembly of an electrophotographic copier including: means cooperating with an image bearing medium for defining a development zone within which a latent electrostatic image carried by said image bearing medium may be developed; means for directing developer through said development zone for developing a latent electrostatic image therein; sump means for receiving developer after being directed through said development zone; and, toner dispensing means for dispensing fresh toner to said developer prior to its being returned to said directing means by said conveyor means, the improvement comprising wherein said toner dispensing means includes:

a. an elongated tubular housing positioned within and extending across said developer assembly, said housing having an aperture means extending through a lower wall thereof;

b. toner supply means for holding a supply of toner to be dispensed;

c. elongated auger means, one end of said auger means cooperating with and being positioned to receive toner from said toner supply means and the other end of said auger means being positioned within said elongated housing, said auger means having a resilient surface and a helical channel formed therearound within said resilient surface; and, d. means for rotating said auger means, the rotation thereof causing toner positioned within said helical channel to be transferred from said one end of said auger means toward said other end thereof whereby toner will be dispensed through said aperture means into said developer assembly of said helical channel moves thereacross.

12. Apparatus as recited in claim 11 wherein the diameter of said auger means is slightly greater than the inside diameter of said tubular housing such that the resilient surface of said auger means will be slightly compressed within said tubular housing to assist in dispensing toner through said aperture means.

13. Apparatus as recited in claim 11 wherein said elongated housing extends across said developer assembly in a position to dispense toner into said developer as said developer is moving from said development zone toward said sump means to permit mixing of said toner with said developer prior to said developer reaching said sump means.

14. Apparatus as recited in claim 13 and further including mixing means positioned between said development zone and said sump means to receive said developer and said toner for assisting in their mixing.

15. Apparatus as recited in claim 14 wherein said mixing means comprising cross-mixing means for directing toner said developer moving along the edges of said developer assembly towards the center thereof and for directing toner and developer moving along the center of said developer assembly towards the edges thereof.

16. Apparatus as recited in claim 11 wherein said toner supply means comprises a container and wherein said one end of said auger means extends within said container, said container including means therein for metering toner into the portion of the helical channel that is within said container.

17. Apparatus as recited in claim 16 wherein said toner metering means comprises agitator means for agitating said toner within said container.

18. Apparatus as recited in claim 17 wherein said agitator means comprises a pair of vibrating plates in contact with said auger means for directing toner into said helical channel.

19. Apparatus as recited in claim 18 and including means on said auger means cooperating with said vibrating plates for vibrating said plates as said auger means is rotated.

20. Apparatus as recited in claim 11 wherein said toner supply means is positioned outside of said developer assembly.

* * * * *